US011232736B1

(12) United States Patent
Kim et al.

(10) Patent No.: US 11,232,736 B1
(45) Date of Patent: Jan. 25, 2022

(54) METHOD FOR COMPENSATING MURA OF DISPLAY DEVICE AND MURA COMPENSATION SYSTEM

(71) Applicant: SAMSUNG DISPLAY CO., LTD., Yongin-si (KR)

(72) Inventors: Se Yun Kim, Yongin-si (KR); Min Gyu Kim, Yongin-si (KR); Sang Cheol Park, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/313,347

(22) Filed: May 6, 2021

(30) Foreign Application Priority Data

Aug. 19, 2020 (KR) ..... 10-2020-0104203

(51) Int. Cl.
*G09G 3/20* (2006.01)

(52) U.S. Cl.
CPC ..... *G09G 3/20* (2013.01); *G09G 2310/027* (2013.01); *G09G 2310/0278* (2013.01); *G09G 2320/0233* (2013.01); *G09G 2320/0247* (2013.01); *G09G 2360/16* (2013.01)

(58) Field of Classification Search
CPC ..... G09G 3/20; G09G 2310/027; G09G 2310/0278; G09G 2320/0233; G09G 2320/0247; G09G 2360/16
See application file for complete search history.

(56) References Cited

U.S. PATENT DOCUMENTS

| | | | | |
|---|---|---|---|---|
| 9,464,962 | B2 | 11/2016 | Kim et al. | |
| 2020/0211436 | A1* | 7/2020 | Yuan | G11C 19/28 |
| 2020/0211437 | A1* | 7/2020 | Ahn | H01L 27/3225 |
| 2020/0211438 | A1* | 7/2020 | Park | G09G 3/20 |
| 2020/0211448 | A1* | 7/2020 | Zhou | G09G 3/3233 |

FOREIGN PATENT DOCUMENTS

| | | |
|---|---|---|
| KR | 10-084031 | 6/2008 |
| KR | 10-2016-0077977 | 7/2015 |

* cited by examiner

*Primary Examiner* — Sejoon Ahn
(74) *Attorney, Agent, or Firm* — F. Chau & Associates, LLC

(57) ABSTRACT

A mura compensation method for a display device in which a data driver and a scan driver disposed at a first side of a pixel unit, includes capturing an image of the pixel unit based on a predetermined first sample gray level; calculating mum luminance of diagonal mura corresponding to the first sample gray level by sharpening the diagonal mura based on light components of the captured image for a first sample area including the diagonal mura; calculating target luminance based on the mura luminance and a luminance distribution of the imaged first sample area; and calculating a first compensation value corresponding to the first sample gray level and a pixel corresponding to the diagonal mura in the first sample area by using the first sample gray level, the mura luminance, and the target luminance.

20 Claims, 15 Drawing Sheets

METHOD FOR COMPENSATING MURA OF DISPLAY DEVICE AND MURA COMPENSATION SYSTEM

CROSS-REFERENCE TO RELATED APPLICATION

This application claims priority to and benefits of Korean Patent Application No. 10-2020-0104203, filed in the Korean Intellectual Property Office on Aug. 19, 2020, the entire contents of which are herein incorporated by reference.

TECHNICAL FIELD

The present disclosure relates to display compensation, and more particularly, to a mura compensation system and a mura compensation method using the same.

DISCUSSION OF RELATED ART

In general, a display device has a structure in which a scan driver is disposed at a first side of a pixel unit and a data driver is disposed at a second side thereof. For example, the scan driver may be disposed to a left peripheral side of the display device and the data driver may be disposed on a top peripheral side of the display device. However, the presence of these drivers within the periphery of the display device may result in the display device having thick bezels along all sides thereof. Modern display devices seek to reduce the thickness of this bezel. One way to reduce bezel thickness is to provide all drivers on a single side of the display device. Such displays may be referred to as having a single side driving (SSD) structure in which a scan driver and a data driver are disposed together at one side of the display device. In this way, the bezel of the display device may be narrowed.

Display devices having single side driving may be prone to showing mura artifacts, which may resemble darkened or lightened blotches or spots and so such display devices may endeavor to mitigate such artifacts by compensation.

SUMMARY

A mura compensation method for a display device in which a data driver and a scan driver disposed at a first side of a pixel unit, includes capturing an image of the pixel unit based on a predetermined first sample gray level; calculating mura luminance of diagonal mura corresponding to the first sample gray level by sharpening the diagonal mura based on light components of the captured image for a first sample area including the diagonal mura; calculating target luminance based on the mura luminance and a luminance distribution of the imaged first sample area; and calculating a first compensation value corresponding to the first sample gray level and a pixel corresponding to the diagonal mura in the first sample area by using the first sample gray level, the mura luminance and the target luminance.

The calculating the mura luminance may include: rearranging the sample areas by rotating coordinates of pixels of each of the sample areas at a predetermined arrangement angle to refer to the diagonal mura as mura in a column direction; calculating a horizontal luminance profile of the sample areas based on averages of the light components in the column direction of the rearranged sample areas; and calculating the mura luminance based on the horizontal luminance profile.

The rearranging of the sample areas may further include calculating an effective width of the diagonal mura based on the arrangement angle.

The calculating of the mura luminance based on the horizontal luminance profile may include calculating an integral value of the horizontal luminance profile, and determining a value obtained by dividing the integral value of the horizontal luminance profile by the effective width as the mura luminance.

The calculating of the target luminance may include determining an average value of luminance of first coordinates and luminance of second coordinates for the horizontal luminance profile as the target luminance.

The first coordinates may be determined based on a left boundary of the diagonal mura, and the second coordinates may be determined based on a right boundary of the diagonal mura.

The pixel unit may further include a second sample area adjacent to the first sample areas. Mura luminance, target luminance, and a second compensation value corresponding to the second sample area may be calculated.

The first compensation value may be applied to a first position of the first sample area, the second compensation value may be applied to a second position of the second sample area, and a compensation value through an interpolation operation of the first compensation value and the second compensation value may be applied to a pixel between the first position and the second position on the diagonal mura.

The mura compensation method may further include: capturing an image of the pixel unit based on a second sample gray level; and calculating the mura luminance, the target luminance, and a second compensation value corresponding to the second sample gray level.

The mura compensation method may further include calculating a compensation value for a gray level between the first sample gray level and the second sample gray level through an interpolation operation using the first sample gray level, the second sample gray level, the first compensation value, and the second compensation value.

A mura compensation system includes: a display device including a pixel unit including pixels connected to data lines and scan lines, a data driver disposed at a first side of the pixel unit to drive the data lines, and a scan driver disposed together with the data driver at the first side of the pixel unit to drive the scan lines; an imaging device configured to acquire luminance of the pixels by imaging the pixel unit that emits light based on a sample gray level; and a luminance compensation device configured to calculate mura luminance by rotating coordinates of sample areas in which diagonal mura of the pixel unit appears, and calculate a compensation value for each of the sample areas for the sample gray level based on the mura luminance and a luminance distribution of each of the sample areas. The scan lines may include main scan lines extending in a first direction and connected to corresponding pixel rows, respectively; and sub-scan lines extending in a second direction different from the first direction, and respectively connected to the main scan lines at contact portions of the pixel unit.

The luminance compensation device may include: a diagonal mura rearrangement circuit configured to rearrange the sample areas by rotating coordinates of the pixels of each of the sample areas at an arrangement angle to refer to the diagonal mura as mura in a column direction; a mura luminance determiner configured to calculate s horizontal luminance profile of each of the sample areas based on averages of the luminance in the column direction of each of the rearranged sample areas, and calculate the mura luminance based on the horizontal luminance profile; a target luminance determiner configured to determine an average value of luminance of first coordinates and luminance of second coordinates for the horizontal luminance profile as target luminance; and a compensation value calculator configured to calculate the compensation value of a pixel corresponding to the diagonal mura by using the sample gray levels, the mura luminance, and the target luminance.

The rearranging of the sample areas may further include calculating an effective width of the diagonal mura based on the arrangement angle.

The mura luminance determiner may calculate an integral value of the horizontal luminance profile, and may determine a value obtained by dividing the integral value of the horizontal luminance profile by the effective width as the mura luminance.

The compensation value calculator may calculate a compensation value for a gray level between the first sample gray level and the second sample gray level through an interpolation operation using the first sample gray level, the second sample gray level, the first compensation value, and the second compensation value.

The display device may further include a memory configured to store the compensation value calculated by the luminance compensation device and a position of the pixel to which the compensation value is applied.

The compensation value may be applied to a contact pixel corresponding to at least one of the contact portions and selected ones of pixels disposed in a same pixel row as the contact pixel.

A length of the sub-scan lines may be gradually increased in the first direction.

In the absence of the luminance compensation, the diagonal mura may be visually recognized along a virtual connection line connecting the contact portions.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION

Figure 1:
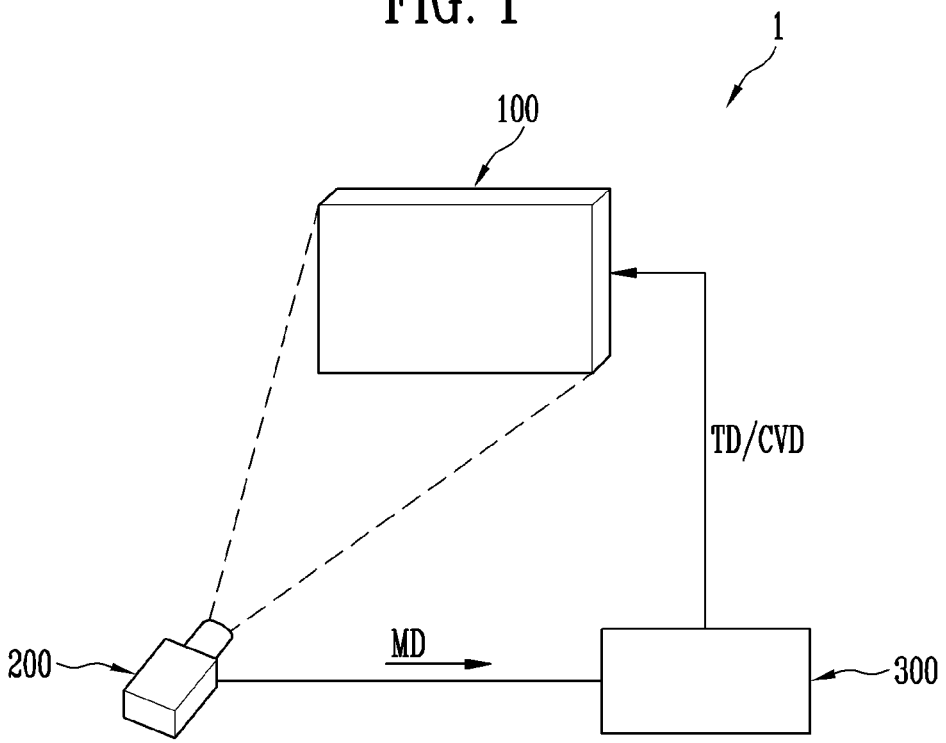
FIG. 1 is a diagram illustrating a mura compensation system according to an embodiment of the present disclosure.

Hereinafter, embodiments of the present disclosure will be described in more detail with reference to accompanying drawings. The same reference numerals may be used for the same or similar constituent elements in the drawings, and to the extent that descriptions for the same constituent elements is omitted, it may be assumed that those constituent elements are at least similar to the corresponding elements that are described herein.

FIG. 1 illustrates a mura compensation system according to an embodiment of the present disclosure.

Referring to FIG. 1, the mura compensation system 1 may include a display device 100, an imaging device 200, and a luminance compensation device 300. The luminance compensation device may be embodied as a logic circuit.

The display device 100, which may be embodied as a display panel, may display an image in response to test data TD supplied from the luminance compensation device 300 or input image data supplied from an external graphic source or the like. The display device 100 may store compensation data CVD supplied from the luminance compensation device 300 in a memory. The test data TD may include image data corresponding to a predetermined sample gray level. As used herein, the term "gray level" may be used to describe a value representing a degree of brightness for a given pixel within a particular range.

The display device 100 may convert input image data based on the compensation data CVD stored in the memory and may display an image corresponding to the converted image data.

In an embodiment, the display device 100 may include a single side driving structure. In this case, when the compensation data CVD is not applied, diagonal mura may be displayed on a pixel unit of the display device 100.

The imaging device 200, which may be embodied as a camera module, may capture an image displayed on the display device 100. For example, the imaging device 200 may measure luminance of various pixels of the display device 100. In an embodiment, the imaging device 200 may be implemented as a charged coupled device (CCD) camera. For example, the imaging device 200 includes a plurality of CCD imaging devices, and each of the CCD imaging devices may generate luminance values in response to pixels of the display device 100 that emit light.

The imaging device 200 may generate measurement data MD including measured luminance values, and may supply the measurement data MD to the luminance compensation device 300.

The luminance compensation device 300 may be embodied as a logic circuit. The luminance compensation device 300 may calculate a compensation value for each pixel or each predetermined region for a sample gray level by using the measurement data MD.

In an embodiment, the luminance compensation device 300 may calculate mura luminance by rotating coordinates of sample areas in which the diagonal mura of the pixel unit appears. The luminance compensation device 300 may calculate a compensation value for each of the sample areas for sample gray levels based on the mura luminance and a luminance distribution of each of the sample areas. The compensation value may be included in compensation data CVD.

The luminance compensation device 300 may write the compensation data CVD into the memory of the display device 100. The memory of the display device 100 may be embodied as a non-volatile memory device, such as flash memory.

Figure 2:
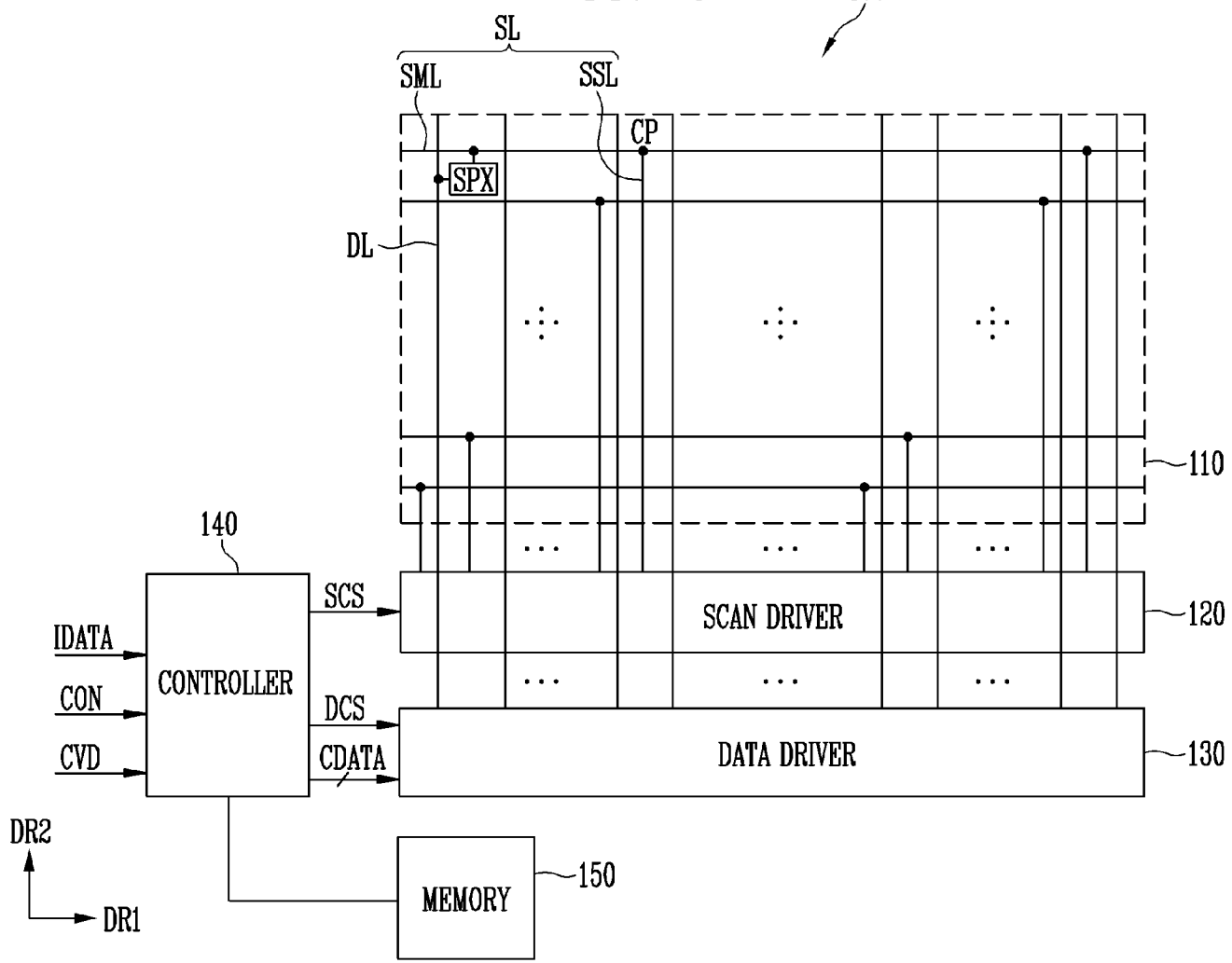
FIG. 2 is a block diagram illustrating an example of a display device including the mura compensation system of FIG. 1.

FIG. 2 is a block diagram illustrating an example of a display device including the mura compensation system of FIG. 1.

Referring to FIG. 2, the display device 100 may include a pixel unit 110 (e.g. a display region that includes a plurality of pixels), a scan driver 120, a data driver 130, and a controller 140. The display device 100 may further include a memory 150. The scan driver 120, the data driver 130, and the controller 140 may each be implemented as a logic circuit.

The display device 100 may be implemented as a liquid crystal display, or, for example, the display device 100 may be an organic light emitting diode (OLED) display including organic light emitting elements, or a display device including inorganic light emitting elements. However, this is merely an example, and the display device 100 may be implemented as an organic light emitting diode display including organic light emitting elements, a display device including inorganic light emitting elements, a plasma display device, a quantum dot display device, or the like.

The display device 100 may be a flat-panel display device, a flexible display device, a curved display device, a foldable display device, or a bendable display device. In addition, the display device may be applied to a transparent display device, a head-mounted display device, a wearable display device, or the like.

The pixel unit 110 may include a plurality of sub-pixels SPX, each of which is connected to a corresponding scan line SL and a corresponding data line DL. The display device 100, according to an embodiment may have a single side driving structure in which a data driver 130 and a scan driver 120 are disposed together at a same side of the pixel unit 110. Each of the scan lines SL may include a main scan line SML and a sub-scan line SSL. In an embodiment, at least one sub-scan line SSL may be connected to the main scan line SML. For example, as illustrated in FIG. 2, two sub-scan lines SSL may be connected to the main scan line SML.

The main scan line SML may extend in a first direction DR1, and may be connected to the sub-pixels SPX of a corresponding pixel row. A scan signal may be supplied to the sub-pixels SPX through the main scan line SML. For example, each main scan line SML defines a pixel row, and the first direction DR) may be a horizontal direction.

Each of the sub-scan lines SSL may extend in a second direction DR2 and may be connected to the main scan line SML through a contact portion CP. In an embodiment, the second direction DR2 may correspond to a pixel array direction or a vertical direction.

The sub-scan lines SSL may electrically connect the scan driver 120 and the main scan line SML. When a single sub-scan line SSL is connected to the main scan line SML, a deviation of a RC load (RC delay) between a portion relatively close to a contact point and a portion relatively far from the contact point may increase. The main scan line SML may be connected to the sub-scan lines SSL to reduce the deviation of the RC load. For example, since the scan signal is supplied to the main scan line SML through the contact portions CP, the deviation of the RC load for each position within the main scan line SML may be reduced. However, this is merely an example, and the number of sub-scan lines SSL connected to the main scan line SML is not limited thereto.

In an embodiment, as illustrated in FIG. 2, the sub-scan lines SSL disposed at a left side of the pixel unit 110 may be arranged to gradually increase in length toward the first direction DR1. For example, virtual connection lines connecting the contact portions CP may have a generally diagonal shape. Similarly, the sub-scan lines SSL disposed at a right side of the pixel unit 110, as illustrated in FIG. 2, may be arranged to gradually increase in length toward the first direction DR1.

The data lines DL may be connected to the sub-pixels SPX in a pixel column unit.

The scan driver 120 may receive a first control signal SCS from the controller 140. The scan driver 120 may supply a scan signal to the scan lines SL in response to the first control signal SCS. The first control signal SCS may include a scan start signal for the scan signal and a plurality of clock signals.

The scan signal may be set to have a gate-on level (low voltage or high voltage) corresponding to a type of a transistor to which the scan signal is supplied.

The data driver 130 may receive a second control signal DCS from the controller 140. The data driver 130 may convert image data CDATA, obtained by correcting input image data IDATA in response to the second control signal DCS, into an analog data signal (data voltage), to supply the data signal to the data lines DL.

The controller 140 may receive an input control signal CON and the input image data IDATA from an image source such as an external graphic device. The controller 140 may generate the corrected image data CDATA by applying the compensation data CVD supplied from the luminance compensation device 300 and stored in the memory to the input image data IDATA. The corrected image data CDATA may be supplied to the data driver 130.

In an embodiment, the controller 140 may generate the first control signal SCS for controlling driving timing of the scan driver 120 and may generate the second control signal DCS for controlling driving timing of the data driver 130 to supply them to the scan driver 120 and the data driver 130, respectively.

The memory 150 may store the compensation data CVD including a compensation value calculated by the luminance compensation device 300 and position information of a pixel to which the compensation value is applied. The compensation data CVD may be read from the memory 150 depending on a command of the controller 140.

In FIG. 2, the scan driver 120, the data driver 130, and the controller 140 are illustrated to have different configurations, but one or more of the scan driver 120, the data driver 130, and the controller 140 may be integrated into one module or integrated circuit (IC) chip. In an embodiment, at least some components and/or functions of the controller 140 may be included in the data driver 130. For example, the data driver 130 and the controller 140 may be included in one source IC.

In addition, the scan driver 120 may include a plurality of scan drivers (e.g., a plurality of scan driving chips or scan driving circuits) each of which is responsible for driving a region of the pixel unit 110. Similarly, the data driver 130 may include a plurality of data drivers (e.g., a plurality of data driving chips or data driving circuits) each of which is responsible for driving a region of the pixel unit 110.

Figure 3A:
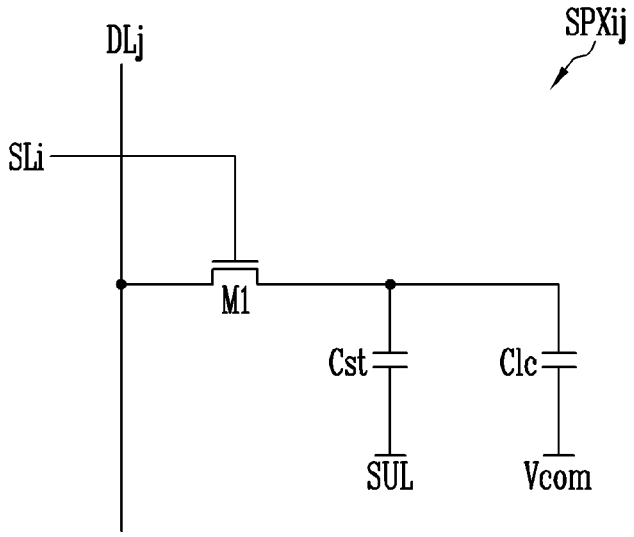
FIG. 3A and FIG. 3B are circuit diagrams illustrating examples of sub-pixels included in the display device of FIG. 2.
Figure 3B:
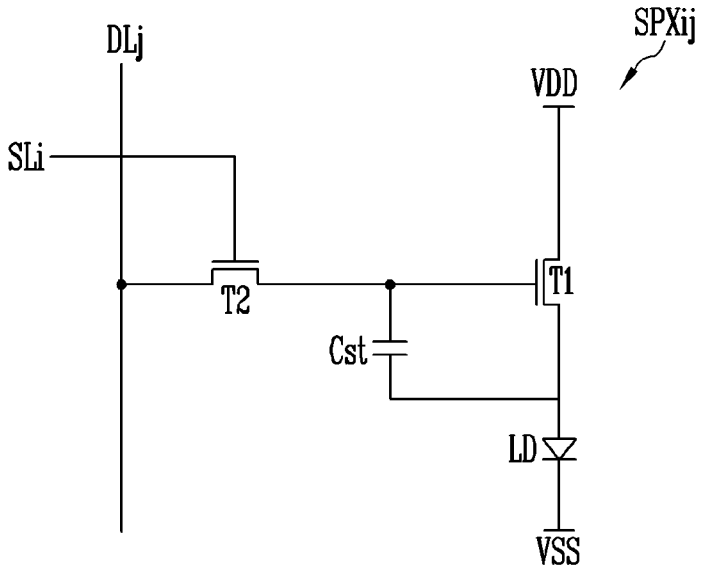

FIG. 3A and FIG. 3B are circuit diagrams illustrating examples of sub-pixels included in the display device of FIG. 2.

Sub-pixels SPXij of FIG. 3A and FIG. 3B are sub-pixels connected to the $i^{th}$ scan line SLi and the $j^{th}$ data line DLj (wherein i and j are positive integers).

Referring to FIG. 2 and FIG. 3A, the sub-pixel SPXij may include a transistor M1, a storage capacitor Cst, and a liquid crystal capacitor Clc.

According to an embodiment, since transistor M1 is illustrated as an N-type transistor, a turn-on level (gate-on level) of the scan signal may be a high level (high level). Those skilled in the art may configure a pixel circuit having the same function by using a P-type transistor.

The transistor M1 may be connected between the $j^{th}$ data line DLj and the storage capacitor Cst. A first electrode of the storage capacitor Cst may be connected to a pixel electrode of the liquid crystal capacitor Clc. A gate electrode of the transistor M1 may be connected to the $i^{th}$ scan line SLi.

The storage capacitor Cst may be connected between the transistor M1 and a storage voltage line SUL. According to an embodiment, when capacity of the liquid crystal capacitor Clc is sufficient, a configuration of the storage capacitor Cst may be omitted.

The pixel electrode of the liquid crystal capacitor Clc is connected to a first electrode of the transistor M1, and a common voltage Vcom may be applied to a common electrode of the liquid crystal capacitor Clc. A liquid crystal layer may be disposed between the pixel electrode and the common electrode of the liquid crystal capacitor Clc. The same common voltage may be applied to the sub-pixels SPX through the common electrode.

When the transistor M1 is turned on by the scan signal supplied to the $i^{th}$ scan line SLi, a voltage corresponding to a difference between a voltage (data signal) applied to the storage capacitor Cst through the $j^{th}$ data line DLj and a storage voltage of the storage voltage line SUL may be stored. The pixel electrode of the liquid crystal capacitor Clc may maintain a voltage corresponding to the data signal by the storage capacitor Cst. Accordingly, an electric field corresponding to a difference between a voltage of the data signal and the common voltage is applied to the liquid crystal layer, and an orientation of liquid crystal molecules of the liquid crystal layer may be determined depending on the electric field. Transmittance may correspond to the orientation of the liquid crystal molecules.

When supply of the scan signal is stopped, for example, when the scan signal transitions to a turn-off level (gate-off level), a kick-back phenomenon in which a gate voltage of the transistor M1 unintentionally changes (e.g., falls) due to a sudden change in the scan signal may occur. An amount of change in this gate voltage may be defined as a kickback voltage. Accordingly, a voltage amount stored in the storage capacitor Cst may change, and luminance of the sub-pixel SPXij may change. This kickback voltage may vary depending on positions of the sub-pixel SPXij and the pixel including the sub-pixel SPXij.

Referring to FIG. 2 and FIG. 3B, the sub-pixel SPXij may include transistors T1 and T2, a storage capacitor Cst, and a light emitting element LD.

The first transistor T1 may be connected between a first power source VDD and the first electrode of the storage capacitor Cst. A gate electrode of the first transistor T1 may be connected to a second electrode of the storage capacitor Cst. The first transistor T1 may be a driving transistor.

The second transistor T2 may be connected between the $j^{th}$ data line DLj and a gate electrode of the first transistor T1. A gate electrode of the second transistor T2 may be connected to the $i^{th}$ scan line SLi. The second transistor T2 may be a scan transistor.

The light emitting element LD may be connected between the first transistor T1 and a second power supply VSS. The light emitting element LD may be an organic light emitting diode, an inorganic light emitting diode, a quantum dot light emitting diode, or the like. Alternatively, the light emitting element LD may include both an inorganic light emitting material and an organic light emitting material.

In an embodiment, the light emitting element LD may control light emission luminance based on an amount of a driving current supplied from the first transistor T1.

The embodiments may be applied not only to the sub-pixels SPXij of FIG. 3A and FIG. 3B, but also to pixels configured with other circuits.

Figure 4A:
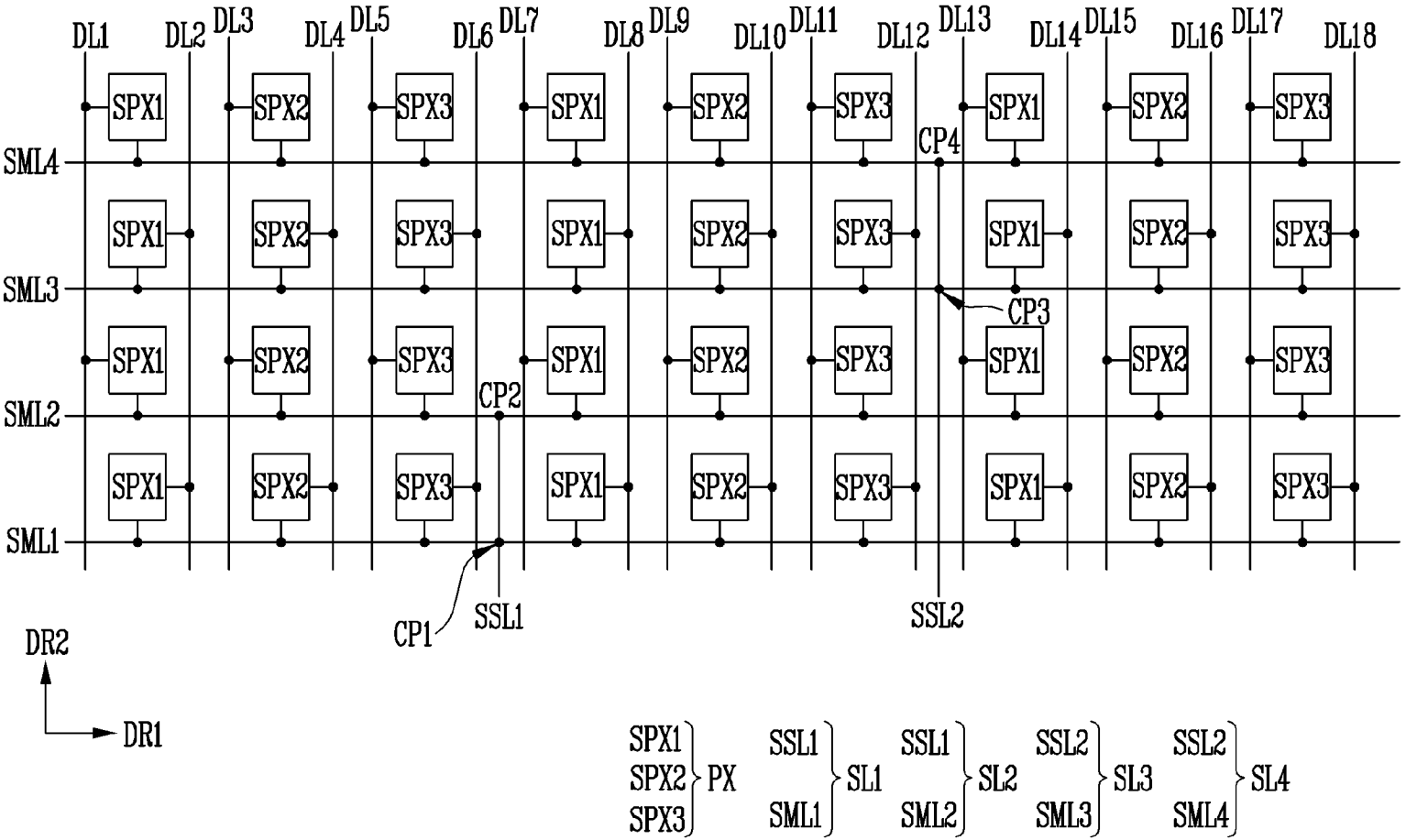
FIG. 4A is a diagram illustrating an example of a pixel unit included in the display device of FIG. 2.
Figure 4B:
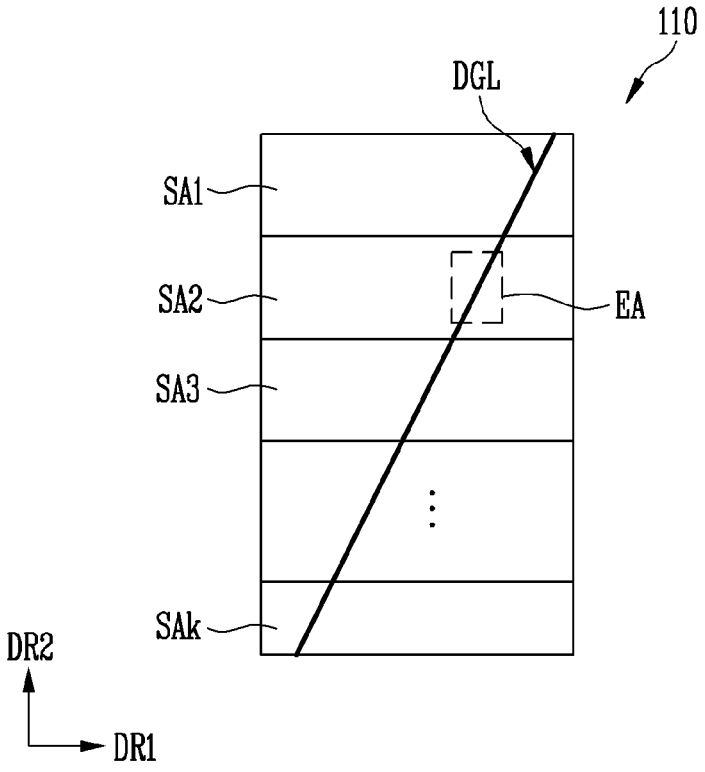
FIG. 4B is a diagram illustrating an example in which a pixel unit included in the display device of FIG. 2 is captured.

FIG. 4A is a diagram illustrating an example of a pixel unit included in the display device of FIG. 2, and FIG. 4B is a diagram illustrating an example in which a pixel unit included in the display device of FIG. 2 is captured.

Referring to FIG. 1, FIG. 2, FIG. 4A, and FIG. 4B, each of the sub-pixels SPX1, SPX2, and SPX3 may be connected to one of the data lines DL1 to DL18 and one of the scan lines SL1 to SL4.

In an embodiment, the second sub-pixel SPX2, and the third sub-pixel SPX3 emit light of different colors, and may together constitute one pixel PX. For example, each of the first sub-pixel SPX1, the second sub-pixel SPX2, and the third sub-pixel SPX3 may emit red light, green light, or blue light.

In the single side driving structure, since the scan driver 120 and the data driver 130 are disposed at a same side of the pixel unit 110, the data lines DL1 to DL18 and the sub-scan lines SSL1 and SSL2 may extend in a same direction (e.g., the second direction DR2).

In an embodiment, the first sub-scan line SSL1 may be commonly connected to the first main scan line SML1 and the second main scan line SLM2. For example, the first sub-scan line SSL1 may be connected to the first main scan line SML1 through a first contact portion CP1 and a second main scan line SML2 through a second contact portion CP2. The first sub-scan line SSL1 and the first main scan line SML1 may constitute the first scan line SL1 corresponding to a first pixel row, and the first sub-scan line SSL1 and the second main scan line SML2 may constitute the second scan line SL2 corresponding to a second pixel row. Accordingly, a scan signal may be simultaneously supplied to the first scan line SL1 and the second scan line SL2.

A period for writing data to the pixel PX may be reduced due to high resolution and high speed driving. For example, one horizontal period for driving one pixel row may be reduced. As illustrated in FIG. 4A, in order to ameliorate this problem, one sub-scan line may be connected to the plurality of main scan lines such that a scan signal is simultaneously supplied to a plurality of pixel rows.

In an embodiment, the data lines DL1 to DL18 are not connected to the sub-pixels in adjacent pixel rows in order to avoid collision of data signal writing as the same scan signal is supplied to the plurality of pixel rows. For example, the first data line DL1 may be connected to the first sub-pixels SPX1 of even-numbered pixel rows of a first pixel column, and the second data line DL2 may be connected to the first sub-pixels SPX1 of odd-numbered pixel rows of the first pixel column. The third data line DL3 may be connected to the second sub-pixels SPX2 of even-numbered pixel rows of a second pixel column, and the fourth data line DL4 may be connected to the second sub-pixels SPX2 of odd-numbered pixel rows of the second pixel column. The fifth data line DL5 may be connected to the third sub-pixels SPX3 of even-numbered pixel rows of a third pixel column, and the sixth data line DL6 may be connected to the third sub-pixels SPX3 of odd-numbered pixel rows of the third pixel column.

In this case, data signals corresponding to the first pixel row and the second pixel row may be simultaneously supplied to the first to $18^{th}$ data lines DL1 to DL18. However, this is merely an example, data signals corresponding to the first pixel row are supplied during a partial period during which the scan signals are supplied to the first and second scan lines SL1 and SL2, and data signals corresponding to the second pixel row may be supplied during another partial period during which the scan signals are supplied.

Similarly, the second sub-scan line SSL2 may be commonly connected to the third main scan line SML3 and the fourth main scan line SML4. For example, the sub-scan line SSL2 may be connected to the third main scan line SML3 through a third contact portion CP3 and the fourth main scan line SML4 through a fourth contact portion CP4. Accordingly, the scan signal may be simultaneously supplied to the third scan line SL3 and the fourth scan line SL4.

In an embodiment, as illustrated in FIG. 4A, one pixel PX may be disposed between the first sub-scan line SSL1 and the second sub-scan line SSL2. With this pattern, contact portions and sub-scan lines may be positioned at predetermined intervals.

As such, each of the scan lines SL1 to SL4 in the pixel unit may have contact portions CP1 to CP4 in the single side driving structure of the display device 100. Experimentally, a difference is generated between a kickback voltage in a vicinity of the contact portions CP1 to CP4 and a kickback voltage at the sub-pixels SPX1, SPX2, SPX3 that are relatively far from the contact portions CP1 to CP4. A deviation of the kickback voltage depending on this position may be recognized as luminance mura (or, luminance unevenness).

FIG. 4B illustrates a diagonal mura DGL appearing in a luminance image captured by the pixel unit 110 emitting light with a predetermined sample gray level. The diagonal mura DGL may appear in a region having a relatively large difference in the kickback voltage with respect to another region.

The diagonal mura DGL may roughly correspond to positions of the contact portions CP1 to CP4. A portion, corresponding to the diagonal mura DGL, in the first pixel row which corresponds to the first scan line SL1 may be predetermined pixels PX adjacent to the first contact portion CP1.

For example, the pixels PX in which the diagonal mura DGL appears may be deflected to a first side of the first contact portion CP1, and may be disposed at opposite sides of the first contact portion CP1. The kickback voltages of the pixels PX in which the diagonal mura DGL appears have a relatively large deviation from the kickback voltages of the other pixels PX.

In an embodiment, the luminance compensation device 300 divides the pixel unit 110 into a plurality of sample areas SA1 to SAk (k being a natural number that is greater than 3), and may perform mura compensation driving for each of the sample areas SA1 to SAk. However, this is merely an example, and the luminance compensation device 300 may perform mura compensation driving by analyzing luminance of the entire pixel unit 110 without distinguishing the sample areas SA1 to SAk.

Figure 5:
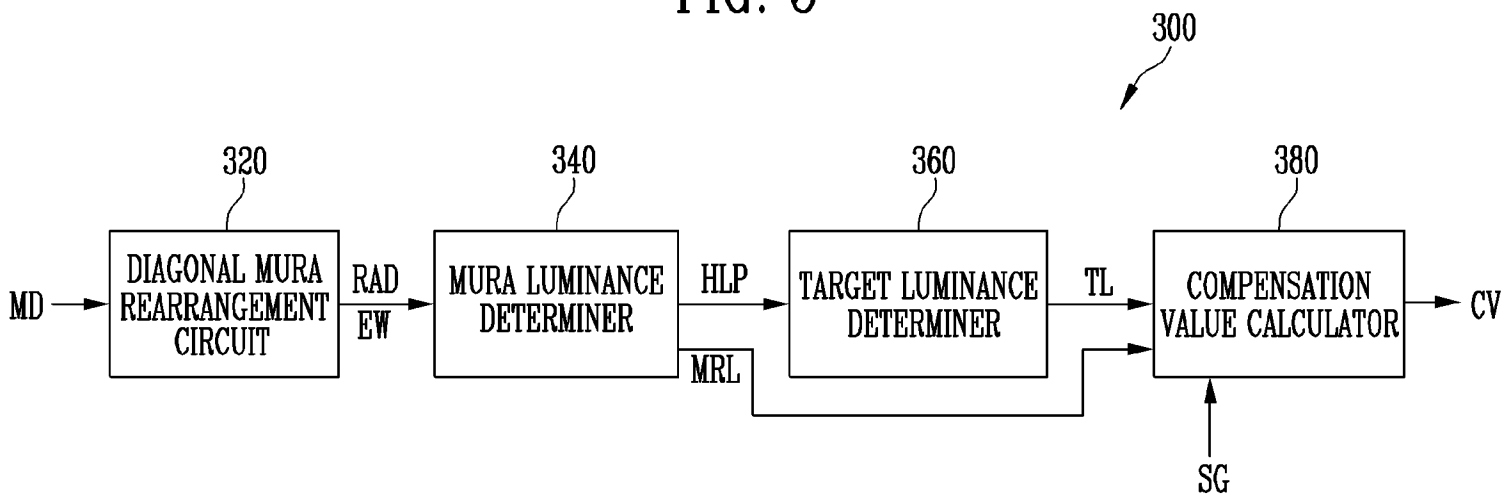
FIG. 5 is a block diagram illustrating an example of a luminance compensation device included in the mura compensation system of FIG. 1.

FIG. 5 is a block diagram illustrating an example of a luminance compensation device included in the mura compensation system of FIG. 1.

Referring to FIG. 1, FIG. 2, FIG. 4B, and FIG. 5, the luminance compensation device 300 includes a diagonal mura rearrangement circuit 320 (which may be embodied as a logic circuit), a mura luminance determiner 340 (which may be embodied as a logic circuit), a target luminance determiner 360 (which may be embodied as a logic circuit), and a compensation value calculator 380 (which may be embodied as a logic circuit).

The luminance compensation device 300 may calculate mura luminance MRL by rotating coordinates of sample areas SA1 to SAk in which the diagonal mura DGL of the pixel unit 110 appears. The luminance compensation device 300 may calculate a compensation value CV for each of the sample areas SA1 to SAk for a sample gray level based on a luminance distribution of each of the sample areas SA1 to SAk. The luminance compensation device 300 may include a hardware configuration and/or software configuration that performs functions of the diagonal mura rearrangement circuit 320, the mura luminance determiner 340, the target luminance determiner 360, and the compensation value calculator 380.

The diagonal mura rearrangement circuit 320 may rearrange coordinates of the pixels PX in each of the sample areas SA1 to SAk to refer to the diagonal mura DGL as mura in the column direction (e.g., second direction DR2). In an embodiment, the diagonal mura rearrangement circuit 320 may rearrange the first sample area SA1 by rotating the coordinates of the pixels PX of the first sample area SA1 at a preset alignment angle based on the measurement data MD supplied from the imaging device 200.

Accordingly, the diagonal mura rearrangement circuit 320 may generate rearrangement data RAD in which each of the sample areas SA1 to SAk is rearranged. The rearrangement data RAD may include position and luminance information of the rearranged pixels PX and sub-pixels SPX.

In an embodiment, the diagonal mura rearrangement circuit 320 may calculate an effective width EW of the diagonal mura DGL based on an arrangement angle.

An example of an operation of the diagonal mura rearrangement circuit 320 will be described in detail with reference to FIG. 6 to FIG. 7B.

The mura luminance determiner 340 may calculate a horizontal luminance profile HLP and mura luminance MRL of each of the sample areas SA1 to SAk based on the rearrangement data RAD and the effective width EW of the diagonal mura DGL.

In an embodiment, the mura luminance determiner 340 may calculate the horizontal luminance profile HLP (or row direction luminance profile) of each of the sample areas SA1 to SAk based on averages of light components (luminance) in the column direction (e.g., the second direction DR2) of each of the rearranged sample areas SA1 to SAk.

The mura luminance determiner 340 may calculate the mura luminance MRL based on the horizontal luminance profile HLP.

In an embodiment, the mura luminance determiner 340 may calculate an integral value of the horizontal luminance profile HLP, and may determine a value obtained by dividing the integral value of the horizontal luminance profile HLP by the effective width EW of the diagonal mura DGL as the mura luminance MRL. Accordingly, the mura luminance MRL may be sharpened to more closely display the actual image.

The target luminance determiner 360 may determine an average value of luminance of first coordinates and luminance of second coordinates for the horizontal luminance profile HLP as the target luminance TL. The horizontal luminance profile HLP may have a luminance difference for each position due to a characteristic variation of each of the pixels PX. The averaged value of such deviations may be set as a target luminance TL.

An example of operations of the mura luminance determiner 340 and the target luminance determiner 360 will be described in detail with reference to FIG. 8 and FIG. 9.

The compensation value calculator 380 may calculate the compensation value CV of the pixel PX or sub-pixel SPX corresponding to the diagonal mura DGL by using sample gray level SG, the mura luminance MRL, and the target luminance TL. An example of an operation of the compensation value calculator 380 will be described in detail with reference to FIG. 10 and FIG. 11.

Figure 6:
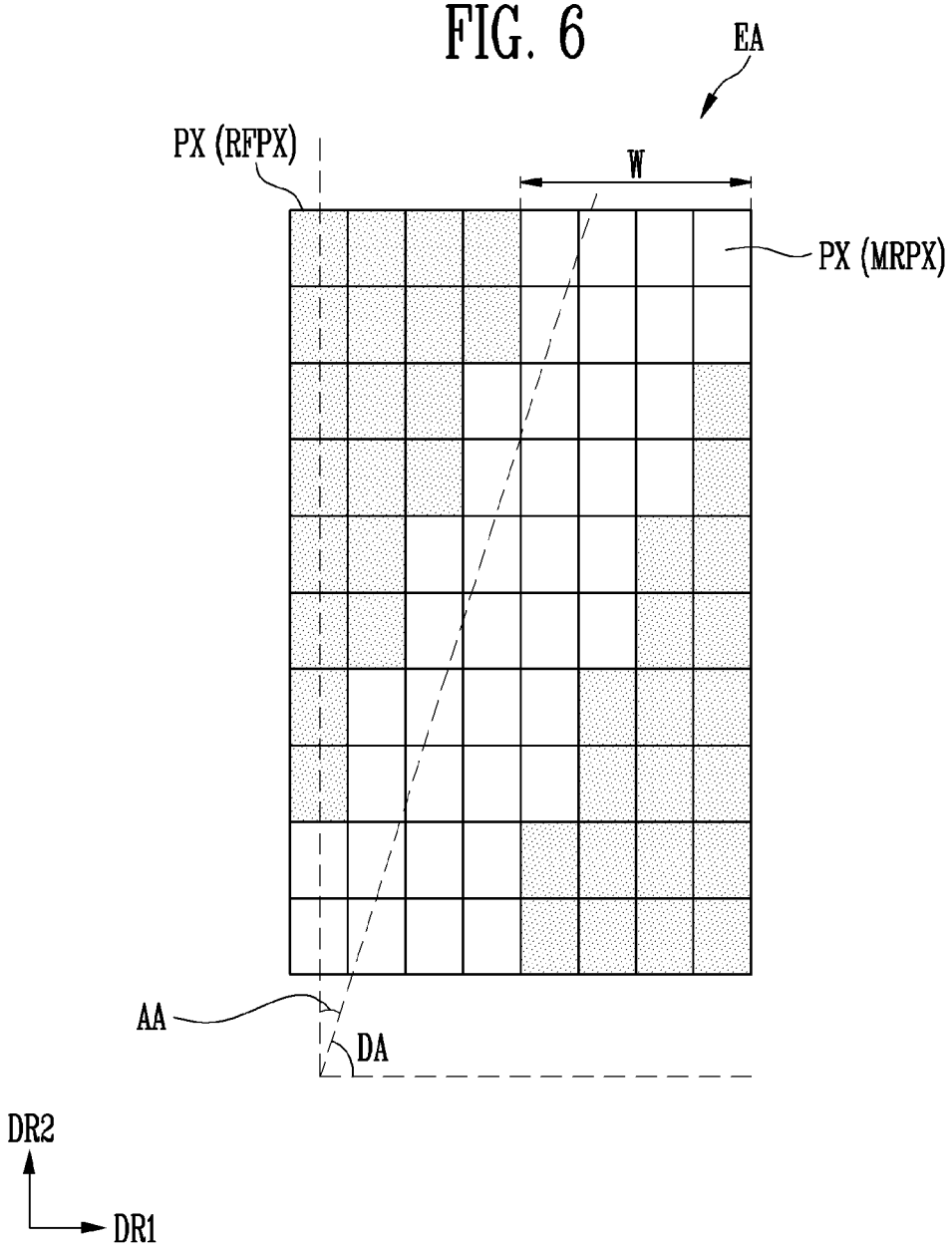
FIG. 6 is an example of a region of the imaged pixel unit of FIG. 4B.
Figure 7A:
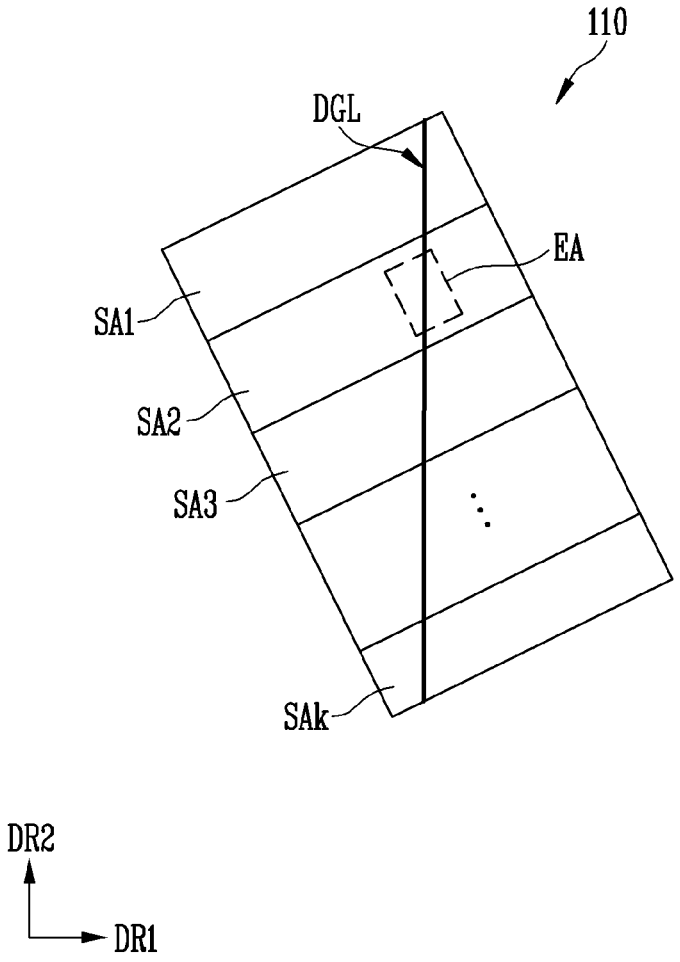
FIG. 7A and FIG. 7B are diagrams illustrating an example of an operation of the luminance compensation device of FIG. 5.
Figure 7B:
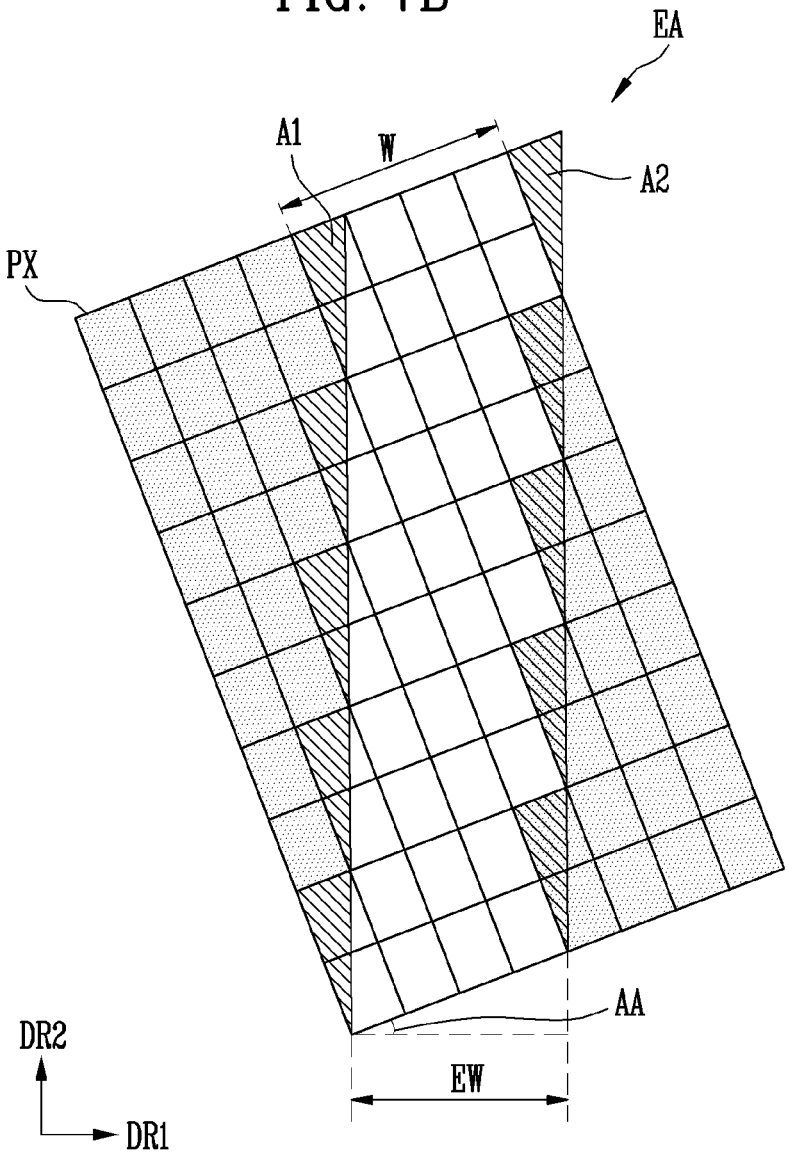

FIG. 6 is a graph illustrating an example of a region of the pixel unit of FIG. 4B, and FIG. 7A and FIG. 7B are graphs illustrating an example of an operation of the luminance compensation device of FIG. 5.

Referring to FIG. 2, FIG. 4B, FIG. 5, FIG. 6, and FIG. 7A, each of the sample areas SA1 to SAk may be rearranged based on a predetermined arrangement angle AA.

Hereinafter, a description will be made on the premise that the pixel PX includes the first to third sub-pixels SPX1, SPX2, and SPX3 described with reference to FIG. 4A.

FIG. 6 illustrates a region EA (as may be seen in FIG. 4B) of the pixel unit 110 including a portion of the diagonal.

In an embodiment, a mura pixel MRPX corresponding to the diagonal mura DGL may be determined by analyzing the measurement data MD.

For example, when the kickback voltage of the reference pixel PX is set as the reference kickback voltage, pixels having a kickback voltage within a predetermined error range from a reference kickback voltage may be determined as general pixels. For example, the luminance compensation according to the embodiments of the present disclosure is not applied to pixels PX in a relatively dark portion of FIG. 6.

The kickback voltage of the mura pixel MRPX may be out of an error range of the reference kickback voltage, and may be a factor of the diagonal mura DGL. In FIG. 6, pixels PX displayed to be brighter than the reference pixel RFPX may be the mura pixels MRPX.

The mura pixels MRPX corresponding to the diagonal mura DGL may be determined based on the contact portion CP of the scan line SL. FIG. 6 illustrates the mura pixels MRPX in a scan line positioning structure described with reference to FIG. 4A. For example, the contact portion CP may be shifted in the first direction DR1 at an interval between two pixel rows. Accordingly, the mura pixels MRPX may be shifted in the first direction DR1 at an interval between two pixel rows. In an embodiment, four pixels PX adjacent to the contact portion CP in one pixel row may be determined as the mura pixels MRPX. These mura pixels MRPX may be determined based on measurement data MD generated from the imaging device 200 of FIG. 1.

In addition, the width W of the diagonal mura DGL in the first direction DR1 may be defined by the pixel PX that is set as the mura pixel MRPX.

Since the contact portions CP are arranged at a regular interval, an inclination angle DA with respect to the first direction DR1 of the diagonal mura DGL defined by the mura pixels MRPX may be determined based on a virtual connection line connecting the contact portions CP.

Meanwhile, as described above, actual luminance of each of the mura pixels MRPX might not be accurately measured due to limitations of the reproducibility of an optical system such as a CCD imaging device. For example, the luminance of the diagonal mura DGL having a very narrow width may be measured to be different from the actual luminance due to an influence of light of the adjacent pixels PX. For example, the measurement data MD has noise and a value in which the luminance of actual mura is dispersed, and when the measurement data MD is used as it is for luminance compensation, accurate luminance compensation might not be achieved.

To correct inaccuracy of luminance compensation based on such imaging, the diagonal mura rearrangement circuit 320 and the mura luminance determiner 340 may sharpen the diagonal mura DGL, and may calculate the mura luminance MRL as a value close to actual emission luminance of the mura pixel MRPX.

The diagonal mura rearrangement circuit 320 may rotate the sample areas SA1 to SAk of the pixel unit 110 based on the arrangement angle AA. Accordingly, as illustrated in FIG. 7A, the diagonal mura DGL may be rearranged in the second direction DR2 or column direction.

In an embodiment, the rearrangement of the coordinates of the pixels PX may be performed by a rotation formula using a trigonometric formula. For example, pixel coordinates of (x, y) may be converted into coordinates of (xcos(AA)−ysin(AA), xsin(AA)+ycos(AA)).

In addition, the diagonal mura rearrangement circuit 320 may calculate the effective width EW of the diagonal mura DGL based on the arrangement angle AA. The effective width EW indicates a width in a normal direction of the diagonal mura DGL. Thereafter, the mura luminance MRL may be determined based on the effective width EW.

As illustrated in FIG. 7B, first portions A1 of the rearranged diagonal mura DGL may be replaced with second portions A2. Accordingly, the rearranged diagonal mura DGL may have a quadrilateral (e.g., parallelogrammic) shape. Accordingly, the effective width EW may be derived as W*cos(AA).

Figure 8:
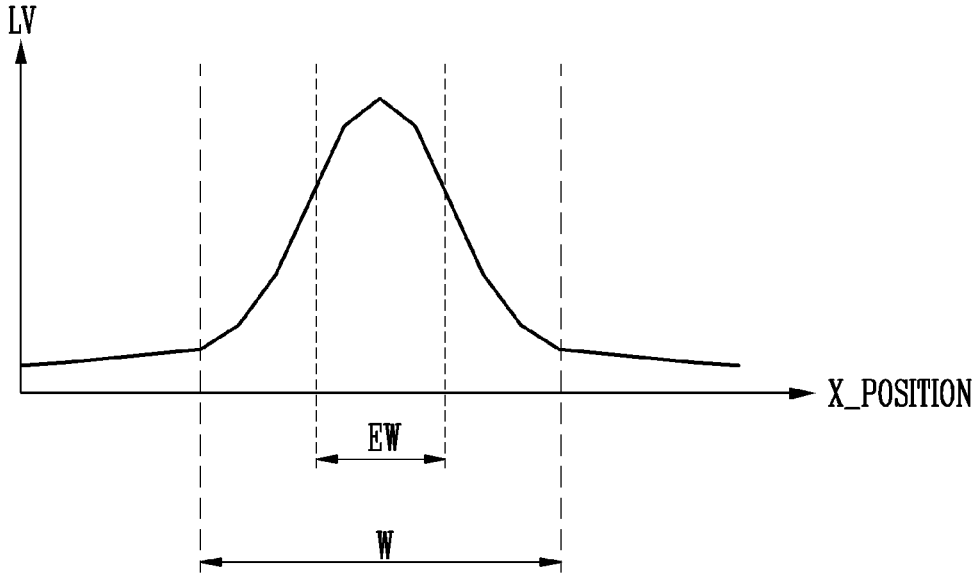
FIG. 8 is a graph illustrating an example of luminance of a region of the captured image of FIG. 4B.
Figure 9A:
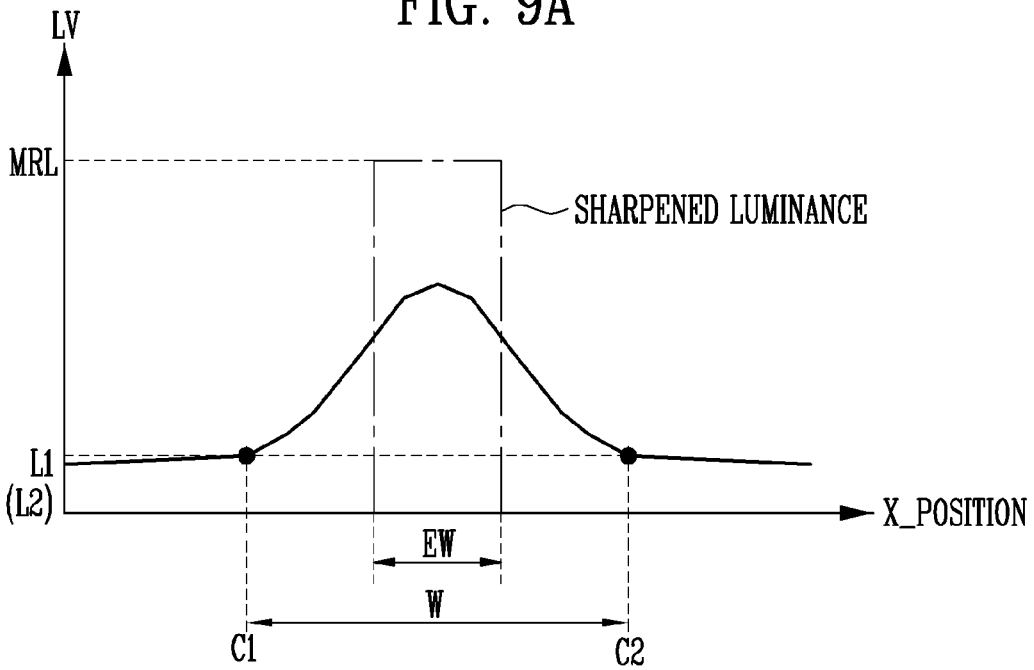
FIG. 9A and FIG. 9B are graphs illustrating examples of calculating mura luminance from luminance of FIG. 8.
Figure 9B:
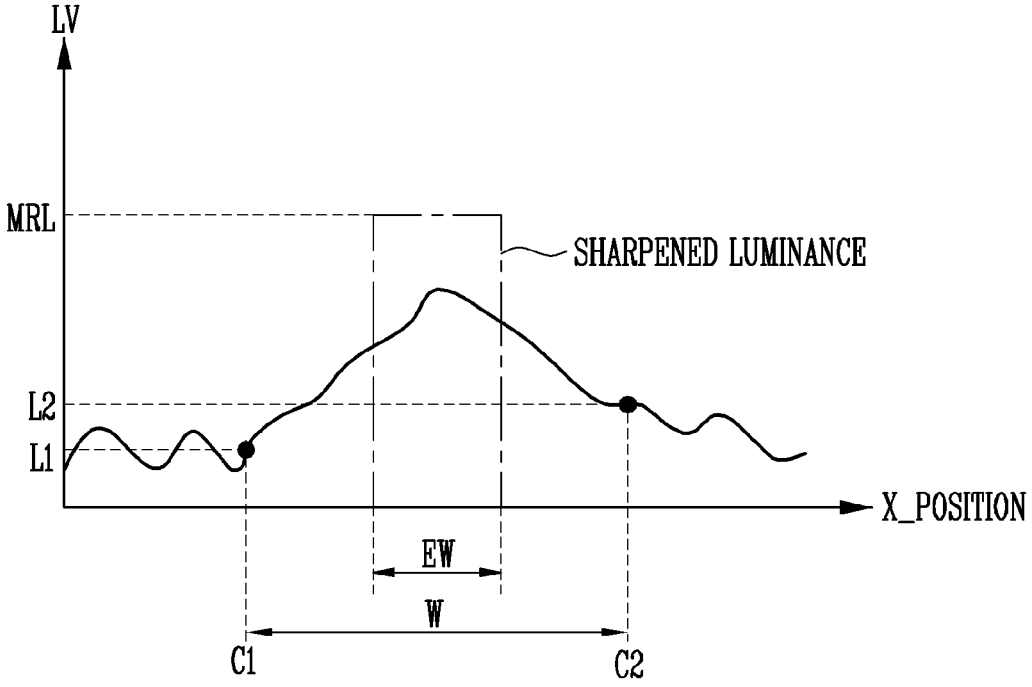

FIG. 8 is a graph illustrating an example of luminance of a region of the captured image of FIG. 4B, and FIG. 9A and FIG. 9B are graphs illustrating examples of calculating mura luminance from luminance of an image of FIG. 8.

Referring to FIG. 2, FIG. 4B, FIG. 5, FIG. 6, FIG. 7B, FIG. 8, FIG. 9A, and FIG. 9B, the horizontal luminance profile HLP and the mura luminance MRL may be determined based on the realignment data RAD including position and luminance information of the rearranged pixels PX and the effective width EW.

In an embodiment, the mura luminance determiner 340 may calculate the horizontal luminance profile HLP of each of the sample areas SA1 to SAk based on averages of light components (luminance) in the column direction (e.g., the second direction DR2) of each of the rearranged sample areas SA1 to SAk. For example, FIG. 8 illustrates the horizontal luminance profile HLP of an area EA of the pixel unit 110 of FIG. 7A. An x-axis of the horizontal luminance profile HLP is a horizontal position of the pixels PX, and the y-axis is luminance LV.

As described above, due to a condensing limit of the imaging device 200, luminance mura tends to spread left and right. For example, actual mura luminance caused by a kickback voltage deviation should be concentrated within the effective width EW, but the mura luminance calculated by the measurement data MD is calculated to be wider (indicated by W in FIG. 8), and has a form that gradually decreases as it moves away from a center thereof.

The mura luminance determiner 340 may determine the mura luminance MRL by using the horizontal luminance profile HLP. In an embodiment, the mura luminance determiner 340 may calculate an integral value of the horizontal luminance profile HLP (e.g., an area of a graph corresponding to the horizontal luminance profile HLP).

Total luminance included in the measurement data MD may be similar to the actual luminance emitted from the display device 100. Therefore, the integral value of the horizontal luminance profile HLP between first coordinates C1 and the second coordinates C2 may be set to be the same as the integral value corresponding to the effective width EW of the sharpened luminance graph including the actual mura luminance MRL.

The width W between the first coordinates C1 and the second coordinates C2 may correspond to a width of the diagonal mura calculated by the measurement data MD. For example, the first coordinates C1 may be coordinates obtained by rotationally transforming the mura pixel MRPX at a left boundary of a corresponding pixel row of FIG. 6, and the second coordinates C2 may be coordinates obtained by rotationally transforming the mura pixel MRPX at a right boundary of a corresponding pixel row of FIG. 6.

Herein, assuming that all the mura luminance MRL of the pixels included in the diagonal mura DGL is the same, a product of the value of the mura luminance MRL and the effective width EW may be equal to the integral value of the horizontal luminance profile HLP. Accordingly, the mura luminance determiner 340 may determine a value obtained by dividing the integral value of the horizontal luminance profile HLP between the first coordinates C1 and the second coordinates C2 by the effective width EW as the mura luminance MRL. The mura luminance MRL may be similar to the actual luminance of the mura pixel MRPX that might not be accurately measured by the imaging device 200.

For example, due to the deviation of the kickback voltage, the mura luminance MRL has a deviation from the luminance of the pixels PX in other parts of the display device 100. Accordingly, a compensation operation for correcting the mura luminance MRL to the target luminance TL is required.

The target luminance determiner 360 may determine an average value of luminance of the first coordinates C1 (e.g., the first luminance L1) and luminance of the second coordinates (e.g., the second luminance L2) of the horizontal luminance profile HLP as the target luminance TL. Accordingly, since the mura luminance MRL is compensated to a level that is similar to the target luminance TL, the diagonal mura DGL may be removed (e.g. compensated for).

As illustrated in FIG. 9A, the first luminance L1 and the second luminance L2 may be the same as each other. In this case, the target luminance TL may be determined to be a same value as the first luminance L1.

As illustrated in FIG. 9B, the luminance in the horizontal direction might not be uniform due to a unique characteristic of each of the pixels PX. In this case, the target luminance TL may be determined as an average value (or an intermediate value) of the first luminance L1 and the second luminance L2.

The horizontal luminance profile HLP, the mura luminance MRL, and the target luminance TL may be independently calculated in each of the sample areas SA1 to SAk.

Figure 10:
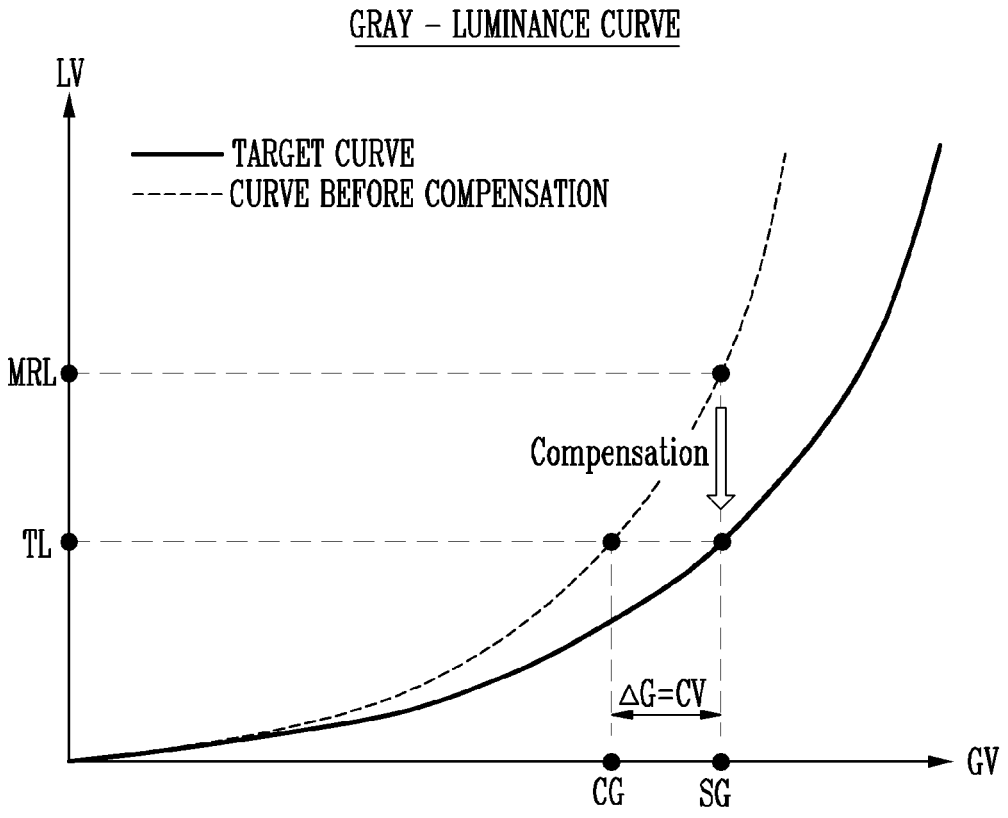
FIG. 10 is a graph illustrating an example in which the luminance compensation device of FIG. 5 calculates a compensation value.

FIG. 10 is a graph illustrating an example in which the luminance compensation device of FIG. 5 calculates a compensation value.

Referring to FIG. 2, FIG. 4B, FIG. 5, FIG. 6, FIG. 78, FIG. 8, FIG. 9A, FIG. 9B, and FIG. 10, a compensation value CV corresponding to sample gray levels SG and a pixel PX (and a sub-pixel SPX) corresponding to the diagonal mura DGL of each of the sample areas may be calculated by using the target luminance TL and the mura luminance MRL of each of the sample gray levels SG.

The mura luminance determiner 340 and the target luminance determiner 360 may calculate the mura luminance MRL and the target luminance TL for each of the sample gray levels SG. In addition, the mura luminance determiner 340 and the target luminance determiner 360 may calculate the mura luminance MRL and the target luminance TL for each of the sample areas SA1 to SAk depending on the sample gray levels SG.

For example, when image data is represented by 256 gray levels, sample gray levels SG may be eight gray levels selected from 256 gray levels. However, this is an example, and the sample gray levels SG are not limited thereto.

In an embodiment, the compensation value calculator 380 may calculate a mura gray level-luminance curve (a graph indicated by a dotted line in FIG. 10) which is a gray level-luminance curve before compensation by applying the mura luminance MRL for each sample gray level SG to a gamma curve. In addition, the compensation value calculator 380 may calculate a target gray level-luminance curve (a graph indicated by a solid line in FIG. 10) by applying the target luminance TL for each sample gray level SG to the gamma curve. The mura gray level-luminance curve and the target gray level-luminance curve may be calculated for each of the sample areas SA1 to SAk.

Referring to the mura gray level-luminance curve and the target gray level-luminance curve, the sample gray level SG (or original gray level) corresponding to the mura luminance MRL is corrected to a compensated gray level CG corresponding to the target luminance TL to compensate the mura luminance MRL with the target luminance TL. The compensation value calculator 380 may calculate the compensation value CV corresponding to a difference between the sample gray level SG and the compensation gray level CG.

Thereafter, the compensation value CV may be applied to image data supplied to a corresponding sub-pixel SPX and/or the mura pixel MRPX of a corresponding sample area.

In an embodiment, the compensation value CV for a gray level between adjacent sample gray levels SG may be calculated through an interpolation operation. For example, compensation values for each of the gray levels between a first sample gray level and a second sample gray level may be calculated through linear interpolation using a first compensation value for the first sample gray level and a second compensation value for the second sample gray level. Accordingly, the compensation values for all gray levels may be applied to the mura pixel MRPX corresponding to the diagonal mura DGL.

As described above, the mura compensation system according to embodiments of the present disclosure may compensate for a kickback voltage deviation depending on arrangement of contact portions of scan lines included in the pixel unit of the display device having the single side driving structure. In particular, a luminance value that is similar to emission luminance of a pixel included in the diagonal mura may be calculated by performing additional image processing on luminance data measured by imaging in order to compensate for the limitation of imaging compensation for diagonal mura with a sharp edge and a narrow width. Accordingly, diagonal mura corresponding to the arrangement of the contact portions may be removed or minimized, and image quality may be increased.

Figure 11:
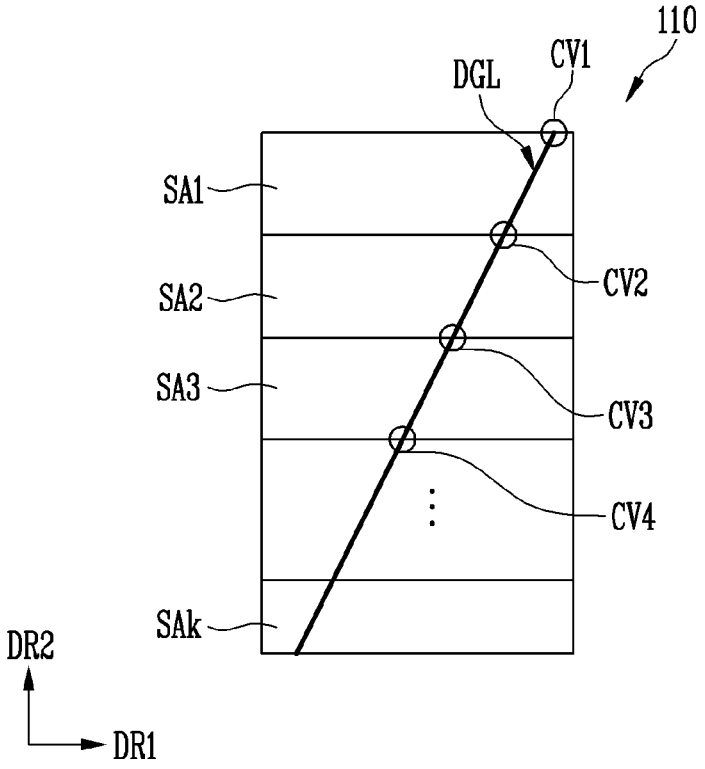
FIG. 11 is a diagram illustrating an example in which the luminance compensation device of FIG. 5 calculates a compensation value depending on a position of a pixel included in a diagonal mura.

FIG. 11 is a graph illustrating an example in which the luminance compensation device of FIG. 5 calculates a compensation value depending on a position of a pixel included in a diagonal mura.

FIG. 11 illustrates compensation values CV1, CV2, CV3, and CV4 for the first sample gray level.

Referring to FIG. 1, FIG. 5, and FIG. 11, the luminance compensation device 300 may calculate the compensation values CV1, CV2, CV3, and CV4 of sample gray levels for each of the sample areas SA1 to SAk.

The luminance compensation device 300 may independently calculate the compensation values CV1, CV2, CV3, and CV4 by dividing the pixel unit 110 into the sample areas SA1 to SAk, and using the driving method described with reference to FIG. 5 to FIG. 10 for each of the sample areas SA1 to SAk. Accordingly, more accurate and fine gray level correction may be performed on a mura deviation within the diagonal mura DGL.

In an embodiment, the first compensation value CV1 may be applied to a first position of the first sample area SA1, and the second compensation value CV2 may be applied to a second position of the second sample area SA2. For example, the first position may be pixels corresponding to the diagonal mura DGL of a first pixel row of the first sample area SA1. The second position may be pixels corresponding to the diagonal mura DGL of a first pixel row of the second sample area SA2.

However, this is an example, and the first position and the second position are not limited thereto. For example, the first position and the second position may each be set as pixels of an intermediate pixel row of a corresponding sample area, or may correspond to a plurality of consecutive pixel rows on the diagonal mura DGL.

In an embodiment, the compensation value calculator 380 or the controller 140 of the display device 100 may calculate a compensation value through an interpolation operation of the first compensation value CV1 and the second compensation value CV2 for each of the pixels between the first and second positions on the diagonal mura DGL. Compensation value calculation driving through such an interpolation operation may be applied to the entire pixel unit 110.

In this way, the compensation value may be subdivided for each sample area and/or for each pixel row (horizontal line). Accordingly, the diagonal mura DGL of the display device 100 having the single side driving structure may be effectively removed, and image quality may be increased.

Figure 12:
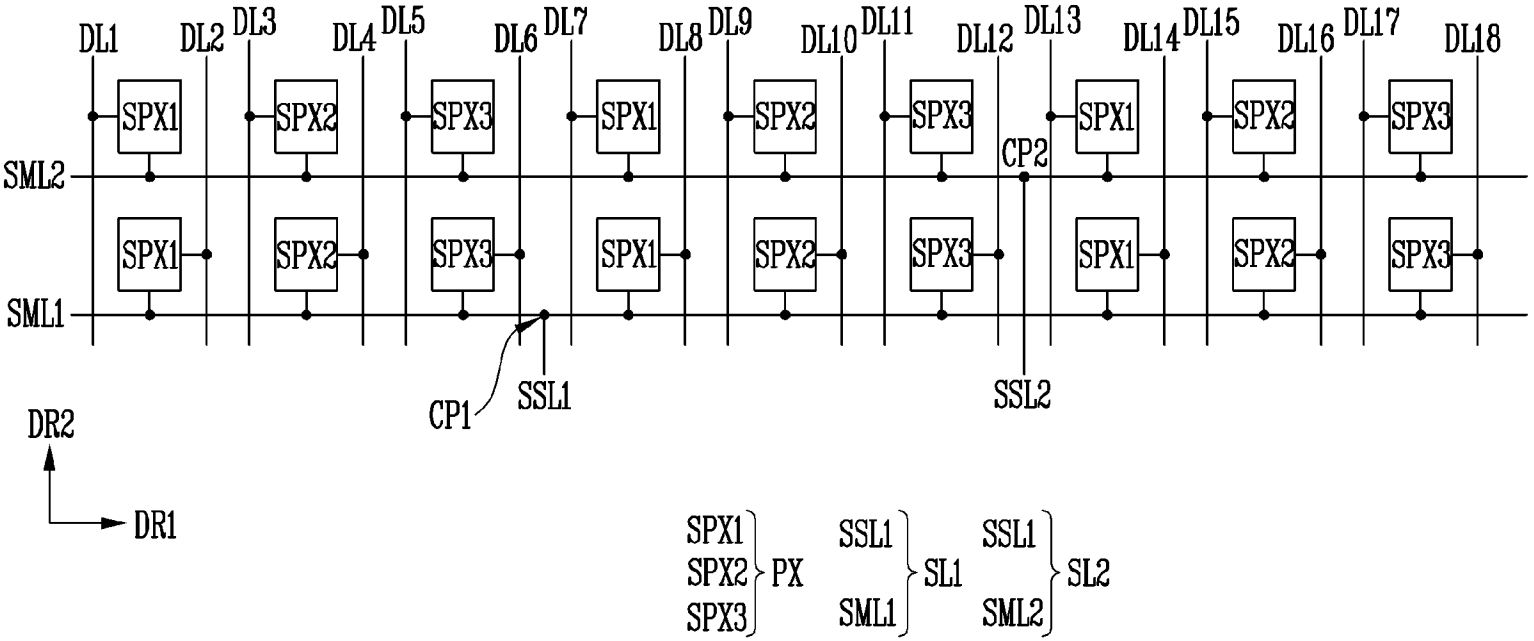
FIG. 12 is a graph illustrating an example of a pixel unit included in the display device of FIG. 2.

FIG. 12 is a diagram illustrating an example of a pixel unit included in the display device of FIG. 2.

In FIG. 12, same or similar constituent elements described with reference to FIG. 4A are denoted by same reference numerals, and redundant descriptions may be omitted. To the extent that descriptions for the same constituent elements is omitted, it may be assumed that those constituent elements are at least similar to the corresponding elements that are described herein. The pixel unit of FIG. 12 may be substantially the same as or similar to the structure of the pixel unit of FIG. 4A except for a configuration in which one sub-scan line is connected to one main scan line.

Referring to FIG. 2 and FIG. 12, each of the sub-pixels SPX1, SPX2, and SPX3 may be connected to one of the data lines DL1 to DL18 and one of the scan lines SL1 and SL2.

In an embodiment, sub-scan lines SSL may be connected one-to-one to main scan lines SML. For example, the first sub-scan line SSL1 may be connected to the first main scan line SML1. For example, a first sub-scan line SSL1 may be connected to a first main scan line SML1 through a first contact portion CP1. The first sub-scan line SSL1 and the first main scan line SML1 may constitute the first scan line SL1 corresponding to the first pixel row.

Similarly, the second line SSL2 may be connected to the second main scan line SML2. For example, a second sub-scan line SSL2 may be connected to a second main scan line SML1 through a second contact portion CP2. The second sub-scan line SSL2 and the second main scan line SML2 may constitute the second scan line SL2 corresponding to a second pixel row.

Figure 13:
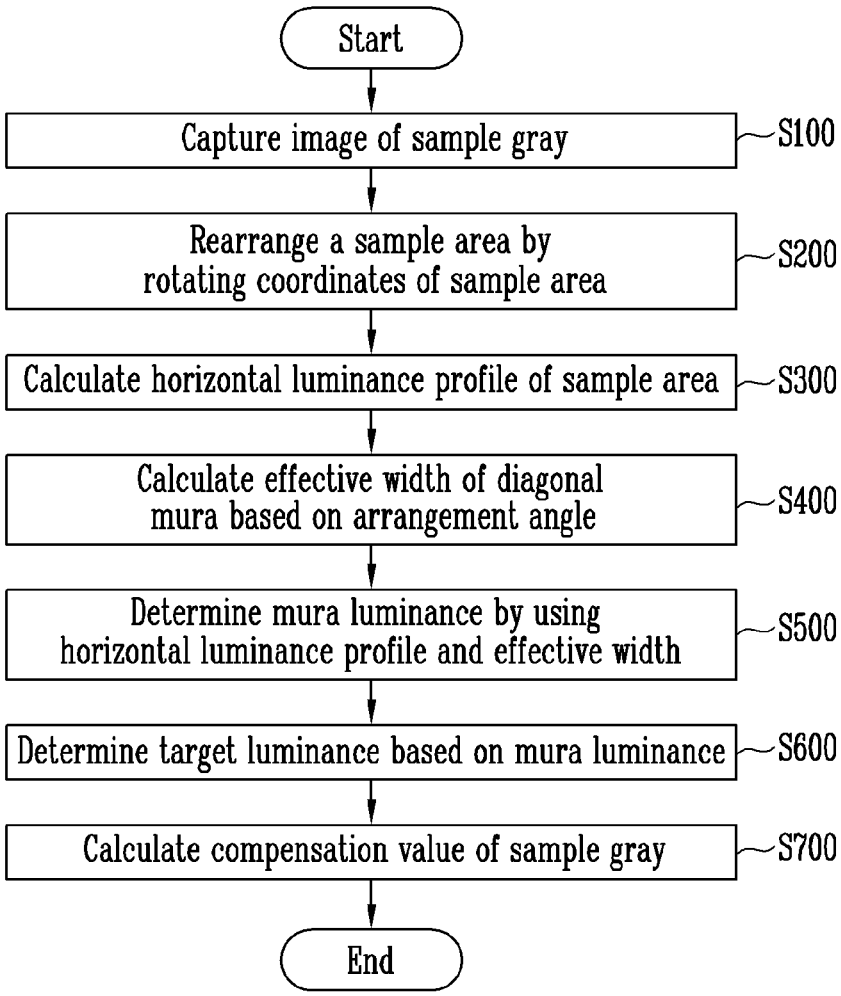
FIG. 13 is a flowchart illustrating a mura compensation method according to an embodiment of the present disclosure.

FIG. 13 is a flowchart illustrating a mura compensation method according to an embodiment of the present disclosure.

Referring to FIG. 13, a mura compensation method for the display device of the single side driving structure may include capturing an image of a sample gray level (S100). Mura luminance of diagonal mura corresponding to the sample gray level may then be calculated (S200, S300, S400, and S500). Target luminance may be calculated based on the mura luminance and luminance distribution (e.g., horizontal luminance profile) of sample areas (S600). A compensation value corresponding to a sample gray level may then be calculated based on the sample gray level, the mura luminance, and the target luminance (S700).

The display device may display an image corresponding to the sample gray level, and an imaging device such as a CCD imaging device may capture luminance of the image (S100). In the display device having the single side driving structure, diagonal mura caused by a kickback deviation of the contact portion of the scan line within the pixel unit may be visually recognized.

The mura luminance of the diagonal mura may be calculated by using measurement data based on a captured image (S200, S300, S400, and S500).

In an embodiment, the sample areas may be rearranged by rotating coordinates of each of the pixels of the sample areas at a predetermined arrangement angle in order to refer to the diagonal mura as mura in a column direction (see FIG. 7A and FIG. 7B).

The horizontal luminance profile of the sample areas may be calculated based on averages of the light components (luminance components) in the column direction of the rearranged sample areas (S300), and an effective width of the diagonal mura may be calculated based on the arrangement angle (S400) (see FIG. 7B and FIG. 8).

Thereafter, in the mura compensation method, an integral value of the horizontal luminance profile may be calculated, and a value obtained by dividing the integral value of the horizontal luminance profile by the effective width may be determined as the mura luminance (S500) (see FIG. 9A and FIG. 9B), The target luminance may be determined based on the mura luminance and the horizontal luminance profile (S600). In an embodiment, an average value of luminance of first coordinates and luminance of second coordinates for the horizontal luminance profile may be determined as the target luminance. The first coordinates may be determined based on a left boundary of the diagonal mura, and the second coordinates may be determined based on a right boundary of the diagonal mura.

Thereafter, a compensation value corresponding to the sample gray level may be calculated by using a gray level-luminance relationship based on the sample gray level, the mura luminance, and the target luminance (S700). The compensation value may be applied to pixels corresponding to diagonal mura in the corresponding sample area (see FIG. 10).

According to an embodiment of the present disclosure, a method for compensating for mura in a display device includes displaying a predetermined image on the display device, measuring an output of the display device, detecting a diagonal mura within the measured output of the display device, calculating a compensation signal that compensates for the detected diagonal mura, and storing the calculated compensation signal within a memory of the display device.

Calculating the compensation signal may include rotating the measured output of the display panel to align the diagonal mura in a column direction, calculating a horizontal luminance profile of the rotated output based on averages of light components in the column direction of the rotated output, and calculating the compensation signal from the calculated horizontal luminance profile of the rotated output.

The method may further include receiving an image signal from an external source, reading the stored compensation signal from the memory, correcting the received image signal using the read compensation signal, and displaying the corrected image signal on the display device.

In an embodiment, the pixel unit includes a plurality of sample areas, and the compensation value may be calculated for each of the sample areas. In an embodiment, the compensation value for each position in each of the sample areas may be additionally determined through an interpolation operation of representative compensation values of the sample areas adjacent to each other.

In an embodiment, the mura compensation method may calculate a compensation value for a plurality of sample gray levels. The compensation value of a gray level between the sample gray levels may be additionally determined through the interpolation operation using adjacent sample gray levels and corresponding compensation values.

As described above, the mura compensation system and the compensation method according to embodiments of the present disclosure may compensate for a kickback voltage deviation depending on arrangement of contact portions of scan lines included in the pixel unit of the display device having the single side driving structure. In particular, a luminance value that is similar to emission luminance of a pixel included in the diagonal mura may be calculated by performing additional image processing on luminance data measured by capturing to compensate for the limitation of imaging compensation for diagonal mura with a sharp edge and a narrow width. Accordingly, diagonal mura corresponding to the arrangement of the contact portions may be removed or minimized, and image quality may be increased.

While embodiments of the present disclosure have been particularly shown and described herein, it will be understood by those skilled in the art that various changes in form and detail may be made therein without departing from the spirit and scope of the present disclosure.

What is claimed is:

1. A method for compensating for mura in a display device in which a data driver and a scan driver are disposed at a first side of a display area of the display device, the method comprising:

capturing an image of the display area of the display device as the display device displays a predetermined first sample gray level;

calculating mura luminance of a diagonal mura corresponding to the first sample gray level by sharpening the diagonal mura based on light components of the captured image for a first sample area including the diagonal mura;

calculating target luminance based on the mura luminance and a luminance distribution of the imaged first sample area; and calculating a first compensation value corresponding to the first sample gray level and a pixel corresponding to the diagonal mura in the first sample area by using the first sample gray level, the mura luminance, and the target luminance.

2. The mura compensation method of claim 1, wherein calculating the mura luminance comprises:

rearranging the first sample area by rotating coordinates of pixels of the first sample area at a predetermined arrangement angle, to arrange the diagonal mura as mura in a column direction;

calculating a horizontal luminance profile of the first sample area based on averages of the light components in the column direction of the rearranged first sample area; and calculating the mura luminance based on the horizontal luminance profile.

3. The mura compensation method of claim 2, wherein rearranging the first sample area further includes:

calculating an effective width of the diagonal mura based on the arrangement angle.

4. The mura compensation method of claim 3, wherein the calculating of the mura luminance based on the horizontal luminance profile includes:

calculating an integral value of the horizontal luminance profile, and determining a value obtained by dividing the integral value of the horizontal luminance profile by the effective width as the mura luminance.

5. The mura compensation method of claim 2, wherein the calculating of the target luminance includes determining an average value of luminance of first coordinates and luminance of second coordinates for the horizontal luminance profile as the target luminance.

6. The mura compensation method of claim 5, wherein the first coordinates are determined based on a left boundary of the diagonal mura, and the second coordinates are determined based on a right boundary of the diagonal mura.

7. The mura compensation method of claim 2, wherein the display area of the display device further includes a second sample area adjacent to the first sample areas, and wherein mura luminance, target luminance, and a second compensation value corresponding to the second sample area are calculated.

8. The mura compensation method of claim 7, wherein:

the first compensation value is applied to a first position of the first sample area, the second compensation value is applied to a second position of the second sample area, and a compensation value through an interpolation operation of the first compensation value and the second compensation value is applied to a pixel between the first position and the second position on the diagonal mura.

9. The mura compensation method of claim 2, further comprising:

capturing an image of the display area of the display device as the display area of the display device displays a predetermined second sample gray level; and calculating mura luminance, target luminance, and a second compensation value corresponding to the second sample gray level.

10. The mura compensation method of claim 9, further comprising:

calculating a compensation value for a gray level between the first sample gray level and the second sample gray level through an interpolation operation using the first sample gray level, the second sample gray level, the first compensation value, and the second compensation value.

11. A mura compensation system, comprising:

a display device including a display area having pixels connected to data lines and scan lines, a data driver disposed at the first side of the display area to drive the data lines, and a scan driver disposed together with the data driver at the first side of the display area to drive the scan lines;

an imaging device configured to acquire luminance of the pixels by capturing the display area as it emits light of a sample gray level; and a luminance compensation device configured to calculate mura luminance by rotating coordinates of sample areas in which diagonal mura of the display area appears, and calculate a compensation value for each of the sample areas for the sample gray level based on the mura luminance and a luminance distribution of each of the sample areas, wherein the scan lines comprise:

main scan lines extending in a first direction and connected to corresponding pixel rows, respectively; and sub-scan lines extending in a second direction different from the first direction, and respectively connected to the main scan lines at contact portions of the display area.

12. The mura compensation system of claim 11, wherein the luminance compensation device comprises:

a diagonal mura rearrangement circuit configured to rearrange the sample areas by rotating coordinates of the pixels of each of the sample areas at an arrangement angle to arrange the diagonal mura as mura in a column direction;

a mura luminance determiner configured to calculate a horizontal luminance profile of each of the sample areas based on averages of the luminance in the column direction of each of the rearranged sample areas, and calculate the mura luminance based on the horizontal luminance profile;

a target luminance determiner configured to determine an average value of luminance of first coordinates and luminance of second coordinates for the horizontal luminance profile as target luminance; and a compensation value calculator configured to calculate the compensation value of a pixel corresponding to the diagonal mura by using the sample gray level, the mura luminance, and the target luminance.

13. The mura compensation system of claim 12, wherein the diagonal mura rearrangement circuit further calculates an effective width of the diagonal mura based on the arrangement angle.

14. The mura compensation system of claim 13, wherein the mura luminance determiner calculates an integral value of the horizontal luminance profile, and determines a value obtained by dividing the integral value of the horizontal luminance profile by the effective width as the mura luminance.

15. The mura compensation system of claim 12, wherein the compensation value calculator further calculates a compensation value for a gray level between the first sample gray level and the second sample gray level through an interpolation operation using the first sample gray level, the second sample gray level, the first compensation value, and the second compensation value.

16. The mura compensation system of claim 12, wherein the display device further comprises:

a memory configured to store the compensation value calculated by the luminance compensation device and a position of the pixel to which the compensation value is applied.

17. The mura compensation system of claim 12, wherein the compensation value is applied to a contact pixel corresponding to at least one of the contact portions and selected ones of pixels disposed in a same pixel row as the contact pixel.

18. The mura compensation system of claim 12, wherein a length of the sub-scan lines is gradually increased in the first direction.

19. A method for compensating for mura in a display device, comprising:

displaying a predetermined image on the display device;

measuring an output of the display device;

detecting a diagonal mura within the measured output of the display device;

calculating a compensation signal that compensates for the detected diagonal mura; and storing the calculated compensation signal within a memory of the display device.

20. The method of claim 19, wherein calculating the compensation signal includes:

rotating the measured output of the display device to align the diagonal mura in a column direction;

calculating a horizontal luminance profile of the rotated output based on averages of light components in the column direction of the rotated output; and calculating the compensation signal from the calculated horizontal luminance profile of the rotated output.

* * * * *